US005346332A

United States Patent [19]

Wagner et al.

[11] Patent Number: 5,346,332

[45] Date of Patent: Sep. 13, 1994

[54] TUBBING-TYPE TUNNEL LINING

[75] Inventors: Harald Wagner, Mauthausen; Alfred Schulter, Linz, both of Austria

[73] Assignee: Ingenieure Mayreder, Kraus & Co. Consult Gesellschaft m.b.H., Linz, Austria

[21] Appl. No.: 68,966

[22] Filed: May 28, 1993

[30] Foreign Application Priority Data

May 29, 1992 [AT] Austria ..... 1123/92

[51] Int. Cl.[5] ..... E21D 11/04

[52] U.S. Cl. ..... 405/153; 405/135; 405/151

[58] Field of Search ..... 405/132, 134, 135, 146, 405/150.1, 151, 152, 153

[56] References Cited

U.S. PATENT DOCUMENTS

| | | | |
|---|---|---|---|
| 4,104,885 | 8/1978 | Thomas | 405/153 |
| 4,515,501 | 5/1985 | Thomas | 405/153 |
| 4,812,084 | 5/1989 | Wagner et al. | 405/153 |

FOREIGN PATENT DOCUMENTS

| | | |
|---|---|---|
| 1658771 | 2/1972 | Fed. Rep. of Germany . |
| 2101092 | 8/1972 | Fed. Rep. of Germany . |
| 2627802 | 9/1989 | France . |
| 823500 | 4/1981 | U.S.S.R. . |
| 2046814 | 11/1982 | United Kingdom . |
| 2103684 | 9/1985 | United Kingdom . |

*Primary Examiner*—David H. Corbin

*Attorney, Agent, or Firm*—Collard & Roe

[57] ABSTRACT

A tubbing-type tunnel lining, which comprises a plurality of tubbing rings, each of which consists of an even number of tubbing blocks, which are similar or identical and have a trapezium-shaped or trapezoidal or diamond basic shape and are so arranged that the joints between adjacent rings are defined by the end faces of said blocks and are connected together by plug-connections, which permit a restricted transmission of shear forces, and in each ring are connected at inclined longitudinal gaps by key-groove connections consisting of continuous longitudinal grooves in inclined longitudinal side faces and keys inserted therein. The blocks themselves have zones which are compressible in the peripheral direction of the tubbing ring and/or said keys are compressible and in a relaxed state of said ring keep the blocks thereof psaced apart so as to define said longitudinal gaps whereas the rings are compressible under the load imposed by the rock so as to reduce the diameter of said ring and the width of said gaps. To ensure a proper guidance of the blocks as the diameter of the tubbing ring is decreased, each tubbing block is connected at each end face by at least two plugs to at least one tubbing block of an adjacent tubbing ring, only one of said two plugs is retained by a locating bearing in the block whereas at least one additional one of said plugs extends in one of the blocks which are connected by said plug in a slot and in response to a decrease of the diameter of the tubbing ring is capable of a limited displacement in said slot.

12 Claims, 3 Drawing Sheets 7
11
12
13
2
16
17
6
12
11
13
10
11
10
12
5
3
11
16
15
1
17
12
13
11
10
13
15
4
10

12
17
8
9
8
10
14
9
13
11
15
16

FIG. 3
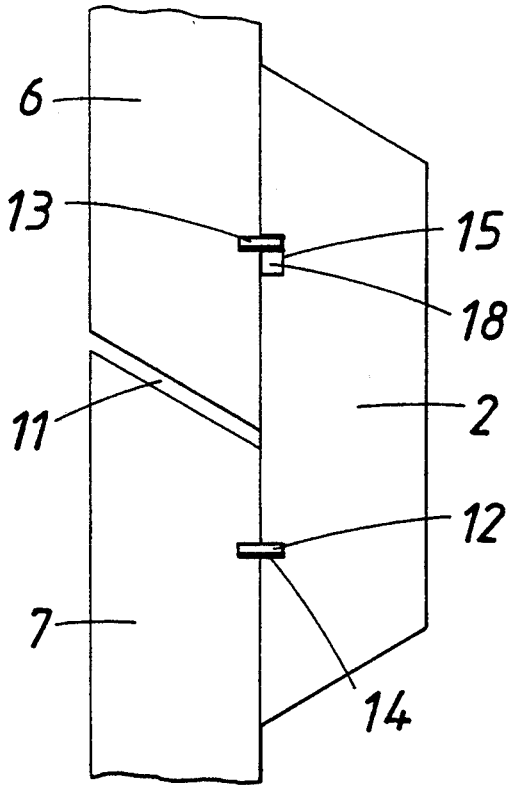
FIG. 4
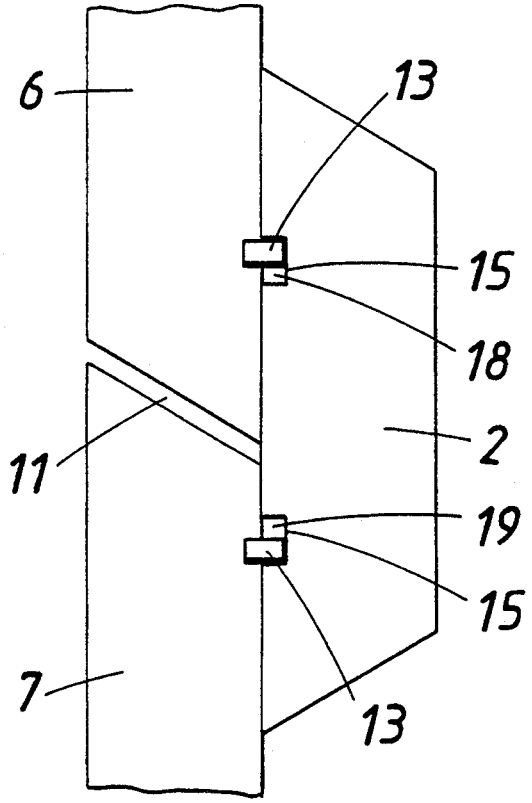
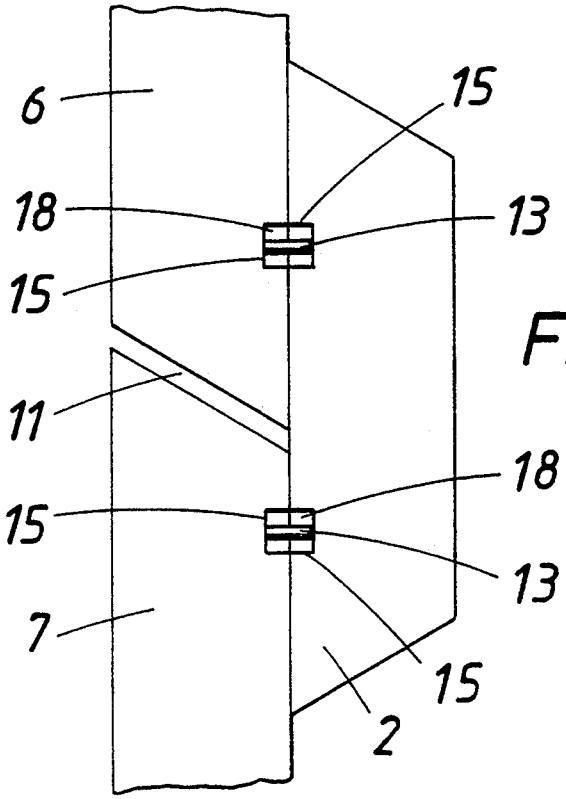
FIG. 5

TUBBING-TYPE TUNNEL LINING

TECHNICAL FIELD

This invention relates to a tubbing-type tunnel lining comprising a plurality of tubbing rings, each of which consists of an even number of tubbing blocks, which are similar or identical and have a trapezium-shaped or trapezoidal or diamond basic shape and are so arranged that the joints between adjacent rings are defined by the end faces of said blocks and are connected together by plug connections, which permit a restricted transmission of shear forces, and in each ring are connected at the inclined longitudinal gaps by key-groove connections consisting of continuous longitudinal grooves in inclined longitudinal side faces and keys inserted therein, wherein said blocks themselves have zones which are compressible in the peripheral direction of the tubbing ring and/or said keys are compressible and in a relaxed state of said ring keep the blocks thereof spaced apart so as to define said longitudinal gaps whereas the rings are compressible under the load imposed by the rock so as to reduce the diameter of said ring and the width of said gaps.

BACKGROUND ART

Such a tunnel lining is known from Ausrian Patent Specification 389,149. A tunnel lining of that kind affords the basic advantage that prefabricated parts can be used, which can be assembled to form modular tubbing rings, which are held together by plugs so that the blocks can be installed immediately after the excavation, and, if possible, under the protection of the shield tail of tunnel-driving machine. A deviation of the course of the tunnel lining from a straight line can be achieved by the use of tubbing blocks, which can be assembled to form tubbing rings having end faces which extend in planes including an acute angle with each other in such a position that two rings, which are assembled to be equal and opposite to each other, constitute a cylindrical tubular section having parallel end faces and the rings can be rotated from that position to permit a deviation of the course of the lining toward the sides and toward the top and bottom. In the design which is known from Austrian Patent Specification 389,149 the keys substantially constitute sliding guides of the blocks as they are assembled and the blocks abut each other almost without a gap at their oblique side faces. In Austrian Patent Application A 323/92, which is no prior publication, it has been proposed to provide keys which are compressible and made, e.g., of properly deformable material, or as tubular members, so that they keep the blocks spaced apart so as to define a gap and under the rock pressure can be compressed so as to reduce the width of the gaps. In that case it is possible to use identical blocks for yieldable and non-yieldable linings.

In soils and rocks which have only a poor inherent carrying capacity or a high deformation capacity, tunnel linings having a limited radial yieldability may be used to permit the economical provision of a lining made of prefabricated parts and to use only elements which can be made at low cost. Because the lining is radially deformable, the pressure exerted by the soil and/or rock initially deforms to a predetermined extent the lining against the deformation resistance which is defined by the upsettable elements. If the extent of the deformation which is possible in view of the properties of the soil and/or rock is sufficiently large the pressure exerted by the soil and/or rock may be caused to decrease as the deformation proceeds and/or the rock may come to a standstill when the defined deformation has been effected. In that case the lining will be subjected to a lighter load than a rigid lining. Examples of additional possible uses of a tunnel or shaft lining of the present kind are shafts and tunnels having thick overburdens and/or subjected to strong rock pressures in Alpine transit routes.

It is also known to provide tunnel linings having relatively large gaps. According to French Patent Specification 2,627,802, housings for containing upsettable elements are provided between tubbings which in their basic shape are rectangular or corrugated or made of corrugated steel material and are joined to the abutting longitudinal edges of the tubbings by screws, optionally with interposed gaskets. In other known designs, rod-like upsettable elements are accommodated in the gaps and are supported at the edges of the two lining elements which define the gap or the upsettable elements may be accommodated in part in said edges. In another known design one element has an edge which faces the gap and carries supporting plates for supporting plugs, which constitute deformable members, which can slidably be inserted into tubes, which extend from the edge of the other element and are installed in the element and at the end of the tube are provided with clamping members or cutting members for acting on the plugs so that the insertion of the plugs into the tubes is opposed by an exactly defined resistance. From Published German Application 21 01 092 it is known to provide yieldable inserts of wood or chipboard between adjacent tubbings. Soviet Union Patent Specification 823,500 teaches the use of concrete tubbings, which have straight parallel longitudinal edges formed with recesses, such as V-shaped grooves, which are used to support upsettable metal bodies, and gaps which are not required as upsettable zones may subsequently be filled with concrete. With the exception of the design disclosed in the above-mentioned French patent specification the entire lining of the tunnel is rendered unstable in part by the existing gaps. The field of application of said known designs is also restricted by the fact that the upsettable elements are mounted at the edges that are parallel to the longitudinal axis of the tunnel. Besides, if upsettable zones are provided only in certain regions, larger gaps will be required for the accommodation of the upsettable elements so that different dimensions will result in the overall lining and tubbings having larger peripheral dimensions must be used in regions having no upsettable zones.

DISCLOSURE OF THE INVENTION

It is an object of the invention to provide a tunnel lining which is of the kind described first hereinbefore and which by the use of simple means can be constructed to constitute a yieldable lining, in which an overloading of the plug connections as a result of a decrease of the diameter of the tubbing ring will be avoided, the forces acting on the plugs can exactly be defined, and the plugs will ensure an exact guidance of the blocks as the diameter of the tubbing rings is decreased.

The object set forth is basically accomplished in that each tubbing block is connected at each end face by at least two plugs to at least one tubbing block of an adjacent tubbing ring, only one of said two plugs is retained by a locating bearing in the block whereas at least one additional one of said plugs extends in one of the blocks which are connected by said plug in a slot and in response to a decrease of the diameter of the tubbing ring is capable of a limited displacement in said slot.

Owing to the design in accordance with the invention a reliable retention and guidance of adjacent blocks are preserved but a sufficient yieldability is provided by the means by which adjacent blocks of adjacent rings are connected so that damage to the plugs or deformations of the rings will be precluded. The blocks of adjacent rings may have the same orientation and in adjacent rings the base of a block of one ring adjoins the narrower parallel side of the adjacent block of the adjacent ring. The locating bearings for one plug in adjacent blocks of adjacent rings may register with each other. In another embodiment a locating bearing for one plug in one block registers with a slot in the adjacent block. In the described arrangement, basically sawtooth-shaped longitudinal gaps are defined in adjacent rings and the steep faces of the sawteeth are defined by the gap between the rings. Alternatively, a base of a block of one ring may register with a narrow side of an adjacent block of an adjacent ring so that longitudinal gaps having equal and opposite inclinations continue throughout the tunnel tube. In that case at least those blocks which have an abutting base may be connected by fixed plugs whereas there are no guide slots or no effective guide slots.

According to a further feature, at least the slidably mounted plug has a non-circular elongate cross-sectional shape having a largest diameter that extends approximately in the longitudinal direction of the cross-section of the slot.

In that case the guidance of the plugs in the slots will be improved and surface contacts and non-linear contacts will be obtained between the flat sides of the plugs and the side faces of the slot so that the pressure per unit of surface area will be relatively low.

The plug extending in the slot may even be used to provide a part of the resistance presented by the tubbing rings to the rock pressure. In a preferred embodiment the cross-section of the slot tapers from that end which contains the plug when the tubbing ring is undeformed toward the other end to a width which is smaller than the diameter of the adjacent portion of the plug. In a further embodiment the slot in addition to the plug contains a filler, which is preferably made of a plastically compressible material. Such a filler may also be useful if the blocks are initially provided only with slots and each plug to be retained in a locating bearing is fixed in the slot by inserts made, e.g., of wood. In that case all designs may comprise identical blocks with identically arranged slots and the locating bearings may be provided in that the plugs are fixed in the slots.

In arrangements in which two or more additional plugs, each of which extends in one-half of its length in a slot, are provided for each block in addition to the plug held in a locating bearing, a definite positioning will desirably be achieved in that the plug to be held in a locating bearing is nearer to the nearer longitudinal side face of the block than any other plug extending in the same block at the same end face.

BRIEF DESCRIPTION OF THE DRAWING

FIGS. 3 to 7 are developed views illustrating various possible arrangements of plugs and slots.

DETAILED DESCRIPTION OF THE PREFERRED EMBODIMENTS

Figure 1:
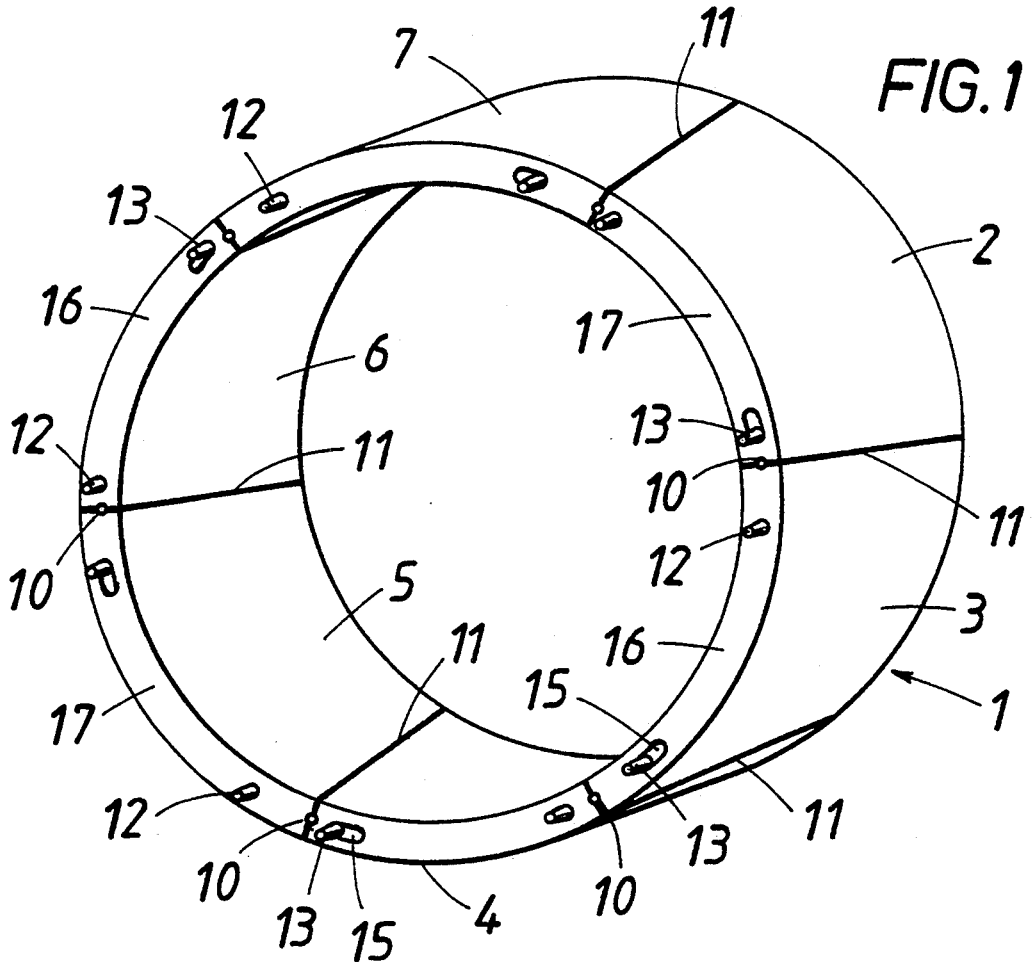
FIG. 1 is a perspective view showing a tubbing ring which can be used in a tunnel lining in accordance with the invention and is provided with plugs for connecting said ring to an adjacent ring.

Further details and advantages of the invention will become apparent from the following description of illustrative embodiments of the invention shown in the drawing.

FIG. 1 shows a tubbing ring 1, which constitutes a part of a tubular tunnel lining. The tubbing ring 1 consists of an even number, for instance, six, basically trapezium-shaped tubbing blocks 2, 3, 4, 5, 6, 7. In each tubbing block the longitudinal edges 8, which constitute the sides of the trapezium, is formed with a groove 9, which is semicircular in cross-section and in which a tubular or rod-shaped key 10 has been inserted, by which the blocks 2 to 7 are retained in a relaxed state so as to define longitudinal gaps 11, which under a pressure applied by the rock may be reduced in width or, in an extreme case, eliminated, with deformation of the keys 10.

Figure 2:
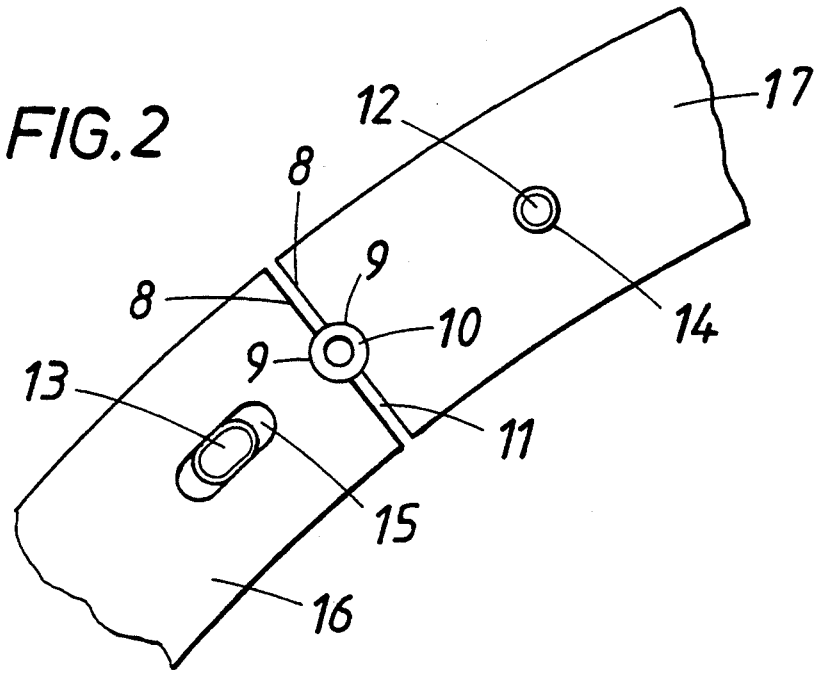
FIG. 2 shows on a scale which is much larger than that of FIG. 1 the joint between two adjacent tubbing blocks of the tubbing ring.

The blocks 2 to 7 of adjacent rings 1 are connected by plugs 12, 13, which extend in holes 14, 15 in the end faces 16, 17 of the blocks. In the embodiment shown in FIG. 2 the plugs 12 and the holes 14 are circular in cross-section and the plugs 13 are elongate in cross-section and extend into slots 15. Alternatively it is possible to provide plugs which have a portion that is circular in cross-section and extends in one block and another portion which is elongate in cross-section and extends in an adjacent block. In a preferred embodiment, identical plugs 13 are used in the locating bearings and in the non-locating bearings and these plug-receiving holes 14 in the blocks which constitute the locating bearings have also an elongate cross-sectional shape corresponding to that of the plugs. The cross-section of the slots 15 may taper in its longitudinal direction.

In the arrangement shown in FIG. 3 the block 2 is formed with a slot 15 and with a hole 14, which conforms to the cross-section of the plug 13. The slot 15 contains a filler 18, which in that case may be made of plastically deformable material.

According to FIG. 4 there are two slots 15 and the plugs 13 having a corresponding elongate shape in cross-section are held in one slot by a plastically deformable filler 18 and in the other slot by a filler 19, by which the plug 13 is rigidly retained. In that case the connected blocks 6 and 7 may be formed with holes conforming to the cross-section of the plugs 13 and both slots 15 in the block 2 may be provided with a plastically yieldable filler.

FIG. 4 shows two slots 15 and plugs 13, which have a corresponding elongate cross-section and are retained in one slot by a plastically yieldable filler 18 and in the other slot by a filler 19 by which the plug 13 is rigidly retained. In that case too the adjacent blocks 6 and 7 may be provided with holes which conform to the plugs 13 in cross-section and a plastically yieldable filler may be provided in each slot 15 of the block 2.

Figure 6:
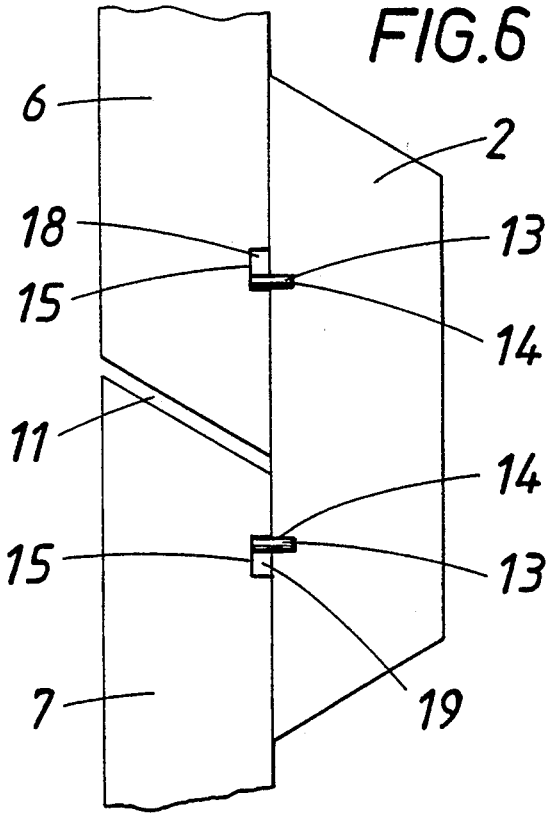

The counterpart of FIG. 4 is shown in FIG. 5, where all blocks 2, 3, 6, 7 are formed with slots 15. The block 2 bridges the gap 11 between the blocks 6, 7 and the plugs 13 are fixed by a means of plastically yieldable filler and a rigid filler, respectively, in the two registering slots 15. In accordance with FIG. 6 the holes 14 for receiving the plugs 13 in the block 2 conform to the cross-section of the plugs to provide locating bearings and the adjacent blocks 6 and 7 are formed with slots 15, which receive the plugs 13 as well as fillers 18 or 19.

Figure 7:
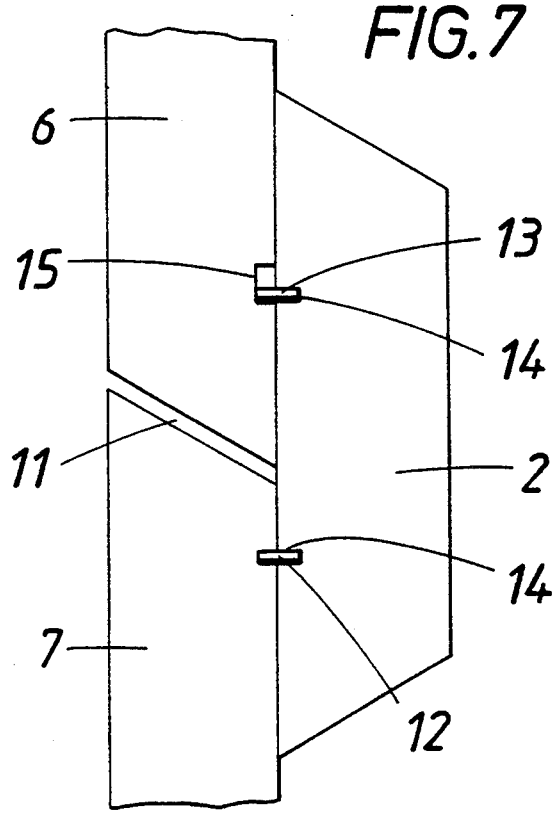

According to FIG. 7 the block 2 is connected to the block 7 by a plug 12 in a locating bearing and to the block 6 by a plug 13, which extends into a slot.

Figure 8:
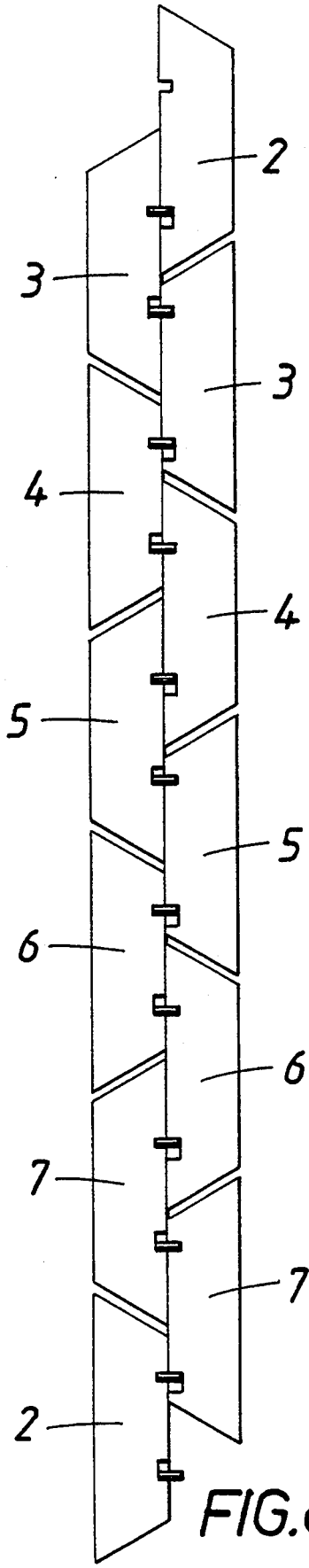
FIG. 8 is another developed view showing two adjacent tubbing rings.

FIG. 8 shows two adjacent tubbing rings, each of which consists of tubbing blocks 2 to 7, and the tubbing rings are interconnected by plugs. Alternate ones of said plugs extend in a locating bearing in one of said rings and in a yieldable bearing in the other ring, and vice versa.

We claim:

1. In a tunnel lining, comprising a plurality of tubbing rings, each of which comprises an even number of similar tubbing blocks each having end faces defining gaps between adjacent ones of said tubbing rings and formed with holes, and inclined side faces defining inclined longitudinal gaps between adjacent blocks of the same ring and formed with continuous longitudinal grooves, a plurality of plugs extending in said holes in adjacent end faces of adjacent ones of said blocks of adjacent ones of said rings and adapted to permit a transmission of limited shear forces between said adjacent rings and a plurality of keys extending in registering ones of said grooves in adjacent ones of said inclined side faces of adjacent ones of said blocks of each of said rings hold said adjacent blocks together, wherein each of said tubbing rings is adapted to assume a relaxed state, in which adjacent ones of said inclined side faces of adjacent ones of said blocks of said ring are spaced apart to define said longitudinal gaps, and each of said tubbing rings when in said relaxed state is adapted to be compressed in its peripheral direction so as to reduce the width of said longitudinal gaps, the improvement residing in that each of said blocks of each of said rings is connected at least on one side of said ring to at least one of said blocks of an adjacent one of said rings by at least two of said plugs, only a first one of which is retained in said connected blocks by a locating bearing formed by one of said holes whereas at least one additional one of said two plugs extends in at least one of said two connected blocks in a slot, which constitutes another one of said holes and permits a limited displacement of said block in response to a compression of the adjacent portion of the associated one of said rings in its peripheral direction.

2. The improvement set forth in claim 1, wherein said tubbing blocks are identical in their basic shape.

3. The improvement set forth in claim 1, wherein said tubbing blocks are trapezium-shaped.

4. The improvement set forth in claim 1, wherein said tubbing blocks are trapezoidal.

5. The improvement set forth in claim 1, wherein said tubbing blocks are diamond-shaped.

6. The improvement set forth in claim 1, wherein each of said blocks of each of said rings has a zone which is compressible in the peripheral direction of said ring.

7. The improvement set forth in claim 1, wherein each of said keys is compressible in the peripheral direction of the associated ring.

8. The improvement set forth in claim 1, wherein at least those of said plugs which are capable of said limited displacement has a non-circular elongate cross-sectional shape having a largest diameter which extends approximately in the direction in which the associated one of said slots is elongate in cross-section.

9. The improvement set forth in claim 1, wherein the cross-section of each of said slots has a first end arranged to receive the associated one of said plugs when said tubbing ring is in said relaxed state and said cross-section tapers toward the other end to a width which exceeds the diameter of the adjacent portion of said plug.

10. The improvement set forth in claim 1, wherein each of said slots contains in addition to the associated one of said plugs a filler made of plastically compressible material.

11. The improvement set forth in claim 1, wherein each of said holes consists of a slot, part of said slots contain said first plugs and in addition thereto rigid fillers to provide locating bearings, and another part of said slots contain said additional plugs and fillers made of plastically deformable material.

12. The improvement set forth in claim 1, wherein each of said first plugs is nearer to the nearer one of said inclined side faces of the associated one of said blocks than any other one of said plugs extending in the same block at the same end face thereof.

* * * * *